US005379467A

United States Patent [19]

Lochbaum

[11] Patent Number: 5,379,467

[45] Date of Patent: Jan. 10, 1995

[54] DEEP WATER EXERCISE AND THERAPY POOL

[76] Inventor: Kenneth Lochbaum, 3002 E. 38th St., Erie, Pa. 16510-2924

[21] Appl. No.: 205,567

[22] Filed: Mar. 4, 1994

[51] Int. Cl.[6] ..... E04H 4/12; E04H 4/14

[52] U.S. Cl. ..... 4/489; 4/494; 4/507; 4/904

[58] Field of Search ..... 4/489, 492, 494, 496, 4/505, 506, 507, 508, 509, 513, 541.1, 541.3, 541.4, 904; 482/55; 119/702

[56] References Cited

U.S. PATENT DOCUMENTS

| | | | |
|---|---|---|---|
| 3,259,105 | 7/1966 | Shepard | 119/29 |
| 3,691,995 | 9/1972 | Little | 119/29 |
| 3,956,779 | 5/1976 | Jewett . | |
| 4,183,329 | 1/1980 | Leonaggeo, Jr. | 119/158 |
| 4,197,815 | 4/1980 | Brazelton | 119/29 |
| 4,203,390 | 5/1980 | Brazelton | 119/29 |
| 4,291,646 | 9/1981 | Leonaggeo, Jr. | 119/29 |
| 4,551,108 | 11/1985 | Bass | 441/116 |
| 4,776,581 | 10/1988 | Shepherdson | 272/65 |
| 4,934,689 | 6/1990 | Burdenko | 272/70 |
| 4,938,469 | 7/1990 | Crandell | 272/69 |
| 5,018,723 | 5/1991 | Burdenko | 272/70 |
| 5,098,085 | 3/1992 | Abboudi | 272/97 |
| 5,123,641 | 6/1992 | Abboudi | 482/54 |
| 5,217,420 | 6/1983 | Abboudi | 482/70 |

FOREIGN PATENT DOCUMENTS

| | | |
|---|---|---|
| 2414106 | 9/1979 | France . |
| 0262590 | 12/1988 | Germany . |
| 4180781 | 6/1992 | Japan . |

*Primary Examiner*—Robert M. Fetsuga
*Attorney, Agent, or Firm*—Charles L. Lovercheck; Wayne L. Lovercheck

[57] ABSTRACT

A water exercise device made up of a closed loop track, a soaking pool and a channel providing a walking path therebetween. The water depth is generally uniform in depth to provide running and walking exercise but deeper areas may be provided to require swimming in a part of the track and total immersion in the soaking pool. A constant water flow rate is maintained in the track and a temperature gradient may be maintained between the track and the soaking pool to provide temperatures appropriate for different activity levels by a user.

21 Claims, 3 Drawing Sheets

DEEP WATER EXERCISE AND THERAPY POOL

BACKGROUND OF THE INVENTION

Applicant is aware of the following Patents: U.S. Pat. No. 3,691,995 to Little, granted Sep. 19, 1972, discloses a swimming pool for exercising and conditioning horses comprising a circular track with a depth that requires swimming, an island in the area enclosed by the track and bridges to the island. Ramps for access to and egress from the pool are provided.

U.S. Pat. No. 4,203,390 to Brazelton, issued May 20, 1980, discloses a closed loop pool for exercising horses with a central island, and a longitudinally shiftable bridge to access the island. The depth of the pool requires swimming around the island from the entry area to the exit area. Concrete and stainless steel are disclosed as preferred construction materials. Ramp entry and a stairs and ramp exit are disclosed. Water circulation means are disclosed to facilitate water filtration. No current is generated to vary swimming conditions.

U.S. Pat. No. 3,259,105 to Shepard issued Jul. 5, 1966, discloses a circular swimming depth exercise pool for horses with a ramp for entry and exit and a draw bridge across the entry to provide a walkway for a trainer.

U.S. Pat. No. 4,934,689 to Burdenko, issued Jun. 19, 1990, discloses one or two exercise pools in the enclosed area, reached by arch type bridges high enough that they do not obstruct users of the pool. Also disclosed are jets of water to create a variation of conditions to eliminate monotony in training and create fun.

U.S. Pat. No. 4,197,815 to Brazelton, issued Apr. 15, 1980, discloses an exercise pool for animals of a depth sufficient to require swimming and pumping sufficient water to establish a current to swim against.

The soaking pool of the present invention has an inclined bottom that is not shown in Burdenko. Doors or other structure separating the soaking from the loop pools are not shown in any of the references. The widening of the loop to prevent whirlpooling at the doors is not shown in the references.

SUMMARY OF THE INVENTION

A water exercise device made up of an oval shaped water container holding water about four feet deep, for example. In a second embodiment a part of the oval shaped track is deepened to a depth of about seven feet so that a person walking through the water on the track will have to swim across the deepened space. An island is formed at the center of the track. A soaking pool is formed in the island. A channel extends from the track to the soaking pool providing a walkway therebetween. Wall jets are supported on the walls defining the pool to generate a constant water flow and to keep the water in the track flowing around the track to provide a constant water current for a person to walk with or against thereby providing assistance or retardance to walking. A temperature gradient is maintained between the track and the pool by means of water jets provided in the entrance of the channel from the track to the channel and at the entrance from the channel to the soaking pool. It is thereby possible to retain water of a first selected temperature in the soaking pool and a second selected temperature in the track.

It is desirable to maintain different areas of water at different temperatures. The track may be maintained at 80° F. to 88° F. and preferably between 84° F. to 88° F. so that the water will act to cool the body while the person is exercising. This temperature allows a user to exercise for a longer amount of time, thus enabling the person to exercise longer by allowing the body heat to be dissipated. When you are able to exercise longer your muscles are able to get stronger quicker for a given amount of exercise time.

On the other hand, the center soaking pool is maintained at a temperature ranging between 88° F. and 102° F. and preferably from 94° F. to 96° F. to help prevent hypothermia. This pool is useful for lower levels of activity such as rehabilitation therapy when one is unable to exercise as hard or strenuously as when the therapy has been completed. In lower levels of activity the user relies on the water to maintain body temperature while you are exercising so that you can exercise for a longer period in the pool and again the principle applies of getting stronger more quickly within a given amount of exercise time.

The speed of the water flow in the track may range from 3 to 20 mph and optimally approximately 7 to 10 mph to allow the water resistance created to be sufficient to allow the perfect anatomical position during exercise without artificially introducing any other devices to give resistance. The difference in speed preferred depends on the use of the pool. The faster currents are for the stronger users such a training athletes, the weaker currents are more helpful to weaker users such as those in rehabilitation therapy.

The channel jets at the openings at each end of the channel create a stream of water to keep the different temperatures from mixing to maintain the two temperatures.

Exercise pockets may be provided around the outside of the track to provide exercise stations around the track. In water exercise equipment may be stationed in the pockets for use during an exercise regime, while no obstruction is provided to those using the track.

It is an object of the present invention to provide an improved exercise and therapy pool.

It is another object of the present invention to provide a water exercise and therapy pool that is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

BRIEF DESCRIPTION OF THE DRAWING(S)

DESCRIPTION OF THE PREFERRED EMBODIMENT(S)

Now with more particular reference to the drawings, an exercising and conditioning facility 10 is shown comprising a closed loop water lap pool track 12, an island 30, and a soaking pool 40. Facility 10 is suitable for rehabilitation exercise and therapy, as well as athletic exercising and conditioning.

Figure 4:
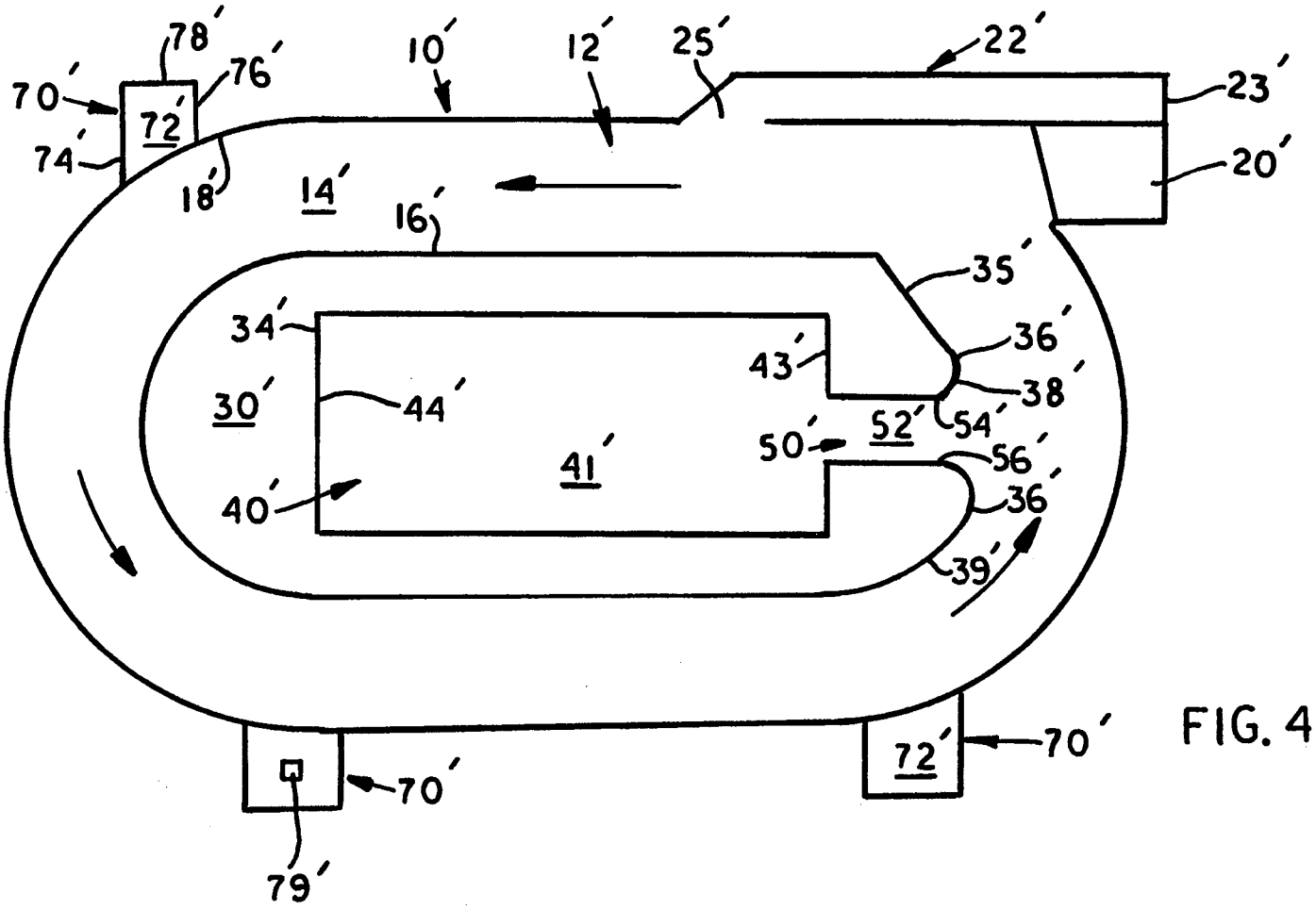
FIG. 4 is a top view taken of an alternative embodiment of the water exercise and therapy device showing exercise pockets and the temperature gradient maintaining water jets in the entrance channel.

Track 12 has stair access 20 and handicapped ramp access 22. Track 12 has substantially flat bottom 14, inner wall 16 and outer wall 18. Track 12 being of a depth, for example four (4) feet, suitable for walking about its entire length as shown in FIG. 4.

In another embodiment, swimming area 60 may be provided where the depth is increased to a point where a standing person would be substantially submerged. The depth may increase to seven (7) feet deep for example. Down slope 62 increases the depth in swimming area 60 from down position 61 through maximum depth position 63 and up slope 64 decreases the depth in swimming area 60 from maximum depth position 63 to up position 65. The preferred seven foot maximum depth of swimming area 60 requires a user to swim for some of the distance between down position 61 and up position 65 on each lap around track 12.

Wall jets 17 are supported in outer wall 18 and in inner wall 16. Water is pumped from pumps 21 through wall jets 17 at a velocity higher than the velocity of water in track 12. Wall jets 17 are inclined at an acute angle to the direction that the water in track 12 is intended to flow to urge water in track 12 to flow in the desired direction at a velocity suitable for walking and running. Sufficient water is pumped to create a constant velocity flow at a predetermined velocity suitable for exercising or conditioning. The flow is also suitable for using surface floats, skiing, boats and other water flotation devices. Inlets 19 supply water to pumps 21 which supply water to wall jets 17.

Island 30 is enclosed by track 12. Bridge 80 provides access from walkway 46 across track 12 to island 30. Bridge 80 has first stairway 82 on the end of island 30, second stairway 84 on the end of walkway 46 and top walkway 86 extending therebetween.

Soaking pool 40 is formed in island 30. Soaking pool 40 may have bottom 41 that inclines downwardly from first end 43 to a greater depth at second end 44 of soaking pool 40. A heat gradient is maintained between soaking pool 40 and track 12. Temperature control means may be used to separate the water in soaking pool 40 from the water in track 12 so that the water in soaking pool 40 may be maintained at a higher temperature than the water in track 12. The temperature difference may be maintained. Doors 58 may be used to separate the different temperature areas. Doors 58 may be double acting so that they may be swung open in either direction.

In another embodiment, temperature gradient water jets 59 may be located on sides 54,56 of channel 54 adjacent track 12 and pool 40. Water jets 59 will project a flow of water angularly across channel 50 to reduce the amount of water moving between track 12 and pool 40, and will enable the temperature gradient to be maintained.

The temperature in soaking pool 40 is maintained at a first temperature that is sufficiently high to reduce the hypothermia in a user of soaking pool 40 due to low physical effort activities. Low effort portions of a conditioning or therapy regimen are conducted in soaking pool 40 where the first temperature will help the user maintain body heat. As the user's body heat is maintained during low effort activities, the user will be able to exercise longer at a particular session, for greater benefit to the user over a shorter overall period of treatment.

The temperature in track 12 is maintained at a second temperature that is kept sufficiently low so that the user will be cooled from his aggressive high physical effort activities in track 12. High effort portions of a therapy or conditioning regimen will be conducted in track 12 or, in another embodiment, in track 12 and in exercise pockets 70 disposed around track 12, where the second temperature will help the user dissipate heat. Thus the user will be able to exercise for a longer period of time at a particular session, for greater benefit to the user over a shorter overall period of treatment.

The temperature difference maintained between soaking pool 40 and track 12 is maintained within a range between 6° F. and 22° F. At less than 6° F. temperature difference the beneficial effects of a temperature difference are not significant. At more than a 22° F. temperature difference, the shock of the change to the user outweighs the benefit of the temperature difference. In a preferred embodiment the temperature difference is maintained within a range of 6° F. to 10° F.

The temperature of the water in track 12 is maintained within a range of 80° F. to 88° F. to provide the beneficial effect of cooling the user during aggressive activities. In a preferred embodiment the temperature of the water in track 12 is maintained within a range of 84° F. to 88° F.

The temperature of the water in soaking pool 40 is maintained within a range of 88° F. to 102° F. to provide the beneficial effect of reducing the hypothermia in a user during low physical effort activities. In a preferred embodiment the temperature of the water in soaking pool 40 is maintained within a range of 94° F. to 96° F.

Wall jets 17 maintain a constant flow current of water around track 12 of about 3 to 20 miles per hour for example or conditioning therapy. At less than 3 mph the resistance or assistance of the flow is not sufficient to provide a benefit. Above 20 mph the benefit to athletes for exercise purposes diminishes because the athlete cannot maintain an upright walking posture at current velocities above 20 mph. Most rehabilitation exercise and therapy and athletic exercise and conditioning will preferably be done at a predetermined constant velocity between 7 to 10 mph. First end 34 and second end 36 of island 30 are generally cylindrical. Second end 36 is divided into first part 38 and second part 39 by entrance channel 50. First part 38 is flattened by straight surface 35 providing a widening of the flow path of track 12 downstream from the intersection of track 12 and channel 50 to prevent a whirlpool flow pattern from developing in the water at second end 36 of island 30 in track 12.

Handicapped access ramp 22 has platform 23 that inclines down from walkway 46 to a depth of about 4 feet at flat part 25.

Entrance channel 50 extends between soaking pool 40 and track 12. Channel 50 has bottom 52, first side 54 and second side 56.

In the embodiment of the invention shown in FIG. 4, an exercise and therapy pool 10' is shown comprising a closed loop water lap pool track 12', an island 30', and a soaking pool 40'.

Track 12' has stair access 20' and handicapped ramp access 22'. Track 12' has bottom 14', inner wall 16' and outer wall 18'. Track 12' being of a depth, for example four (4) feet, suitable for walking and running.

Figures 1, 2, 3:
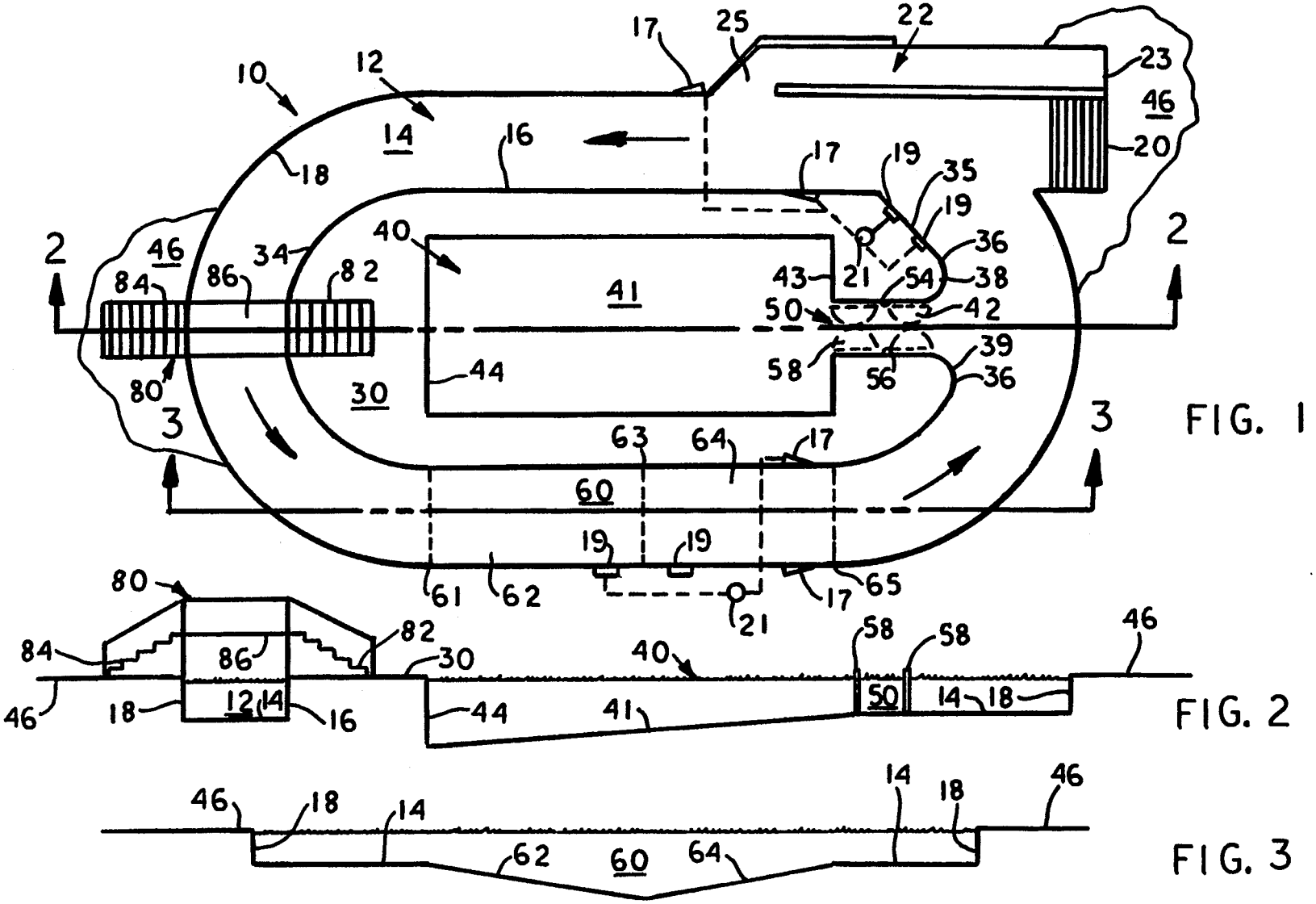
FIG. 1 is a top view of the water exercise and therapy device of the present invention.
FIG. 2 is a cross sectional view taken on line 2—2 of FIG. 1.
FIG. 3 is a cross sectional view taken on line 3—3 of FIG. 1.

Wall jets similar to wall jets 17 shown in FIG. 1 are supported in outer wall 18' and in inner wall 16'. Water from the wall jets flows at a velocity higher than the velocity of water in track 12'. The wall jets are inclined at an acute angle to the direction that the water in track 12' is intended to flow to urge water in track 12' to flow in the desired direction at a velocity suitable for walking and running. Inlets similar to inlets 19 shown in FIG. 1 supply water to pumps that supply water to the wall jets.

Island 30' is enclosed by track 12'. A bridge similar to bridge 80 shown in FIG. 1 provides access from a walk across track 12' to island 30'.

Soaking pool 40' is formed in island 30'. Soaking pool 40' has bottom 41' that inclines downwardly from first end 43' to a greater depth at second end 44' of soaking pool 40'. Doors similar to doors 58 shown in FIG. 1 separate the water in soaking pool 40' from the water in track 12' so that the water in soaking pool 40' may be maintained at a higher temperature than the water in track 12'. A heat gradient is maintained between soaking pool 40' and track 12'.

The wall jets maintain a constant flow current of water around track 12' of about 3 to 20 miles per hour. First end 34' and second end 36' of island 30' are generally cylindrical. Second end 36' is divided into first part 38' and second part 39' by entrance channel 50'. Second part 39' is flattened by straight surface 35' providing a widening of track 12' to prevent a whirlpool flow pattern from developing in the water at second end 36' of island 30' in track 12'.

Handicapped access ramp 22' has platform 23' that inclines down from the walkway to a depth of about 4 feet at flat part 25'.

Figure 5:
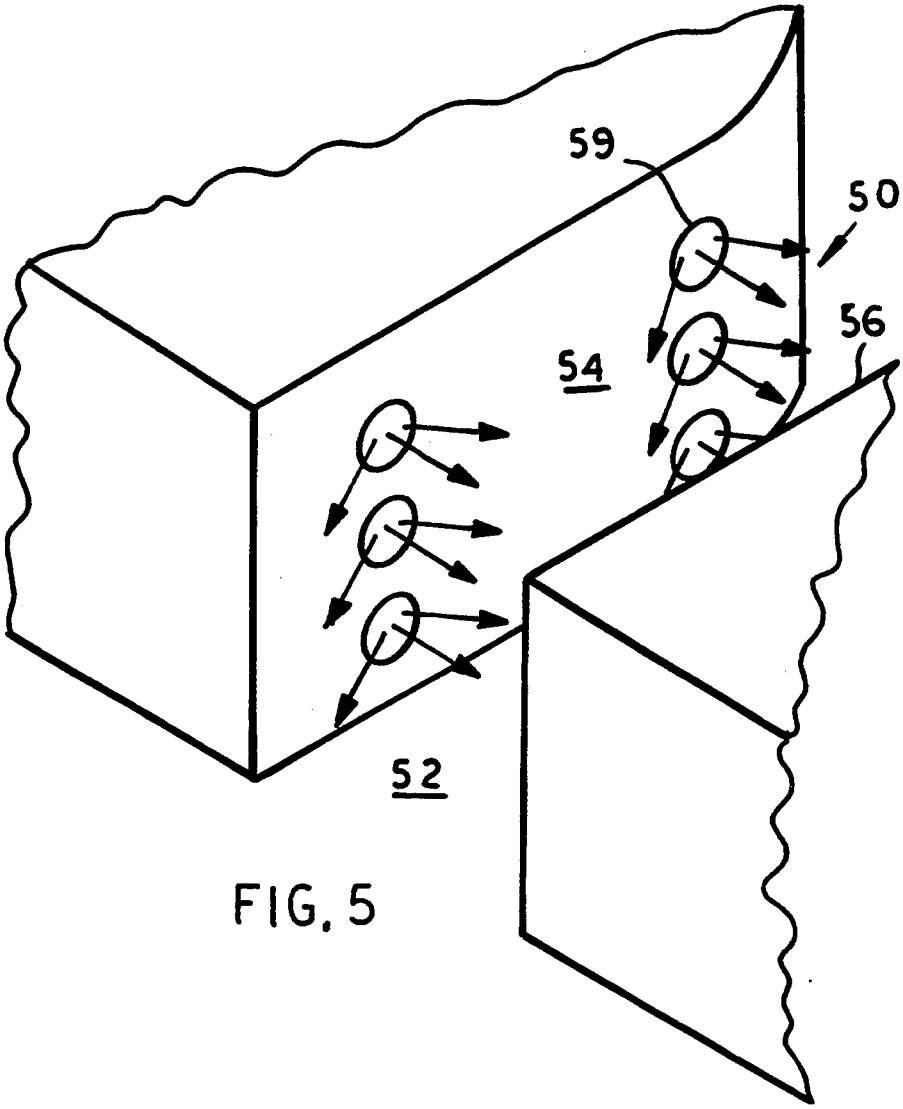
FIG. 5 is an enlarged isometric view showing the channel and the water jets located at the entrances from the channel to the track and to the pool.
Figure 6:
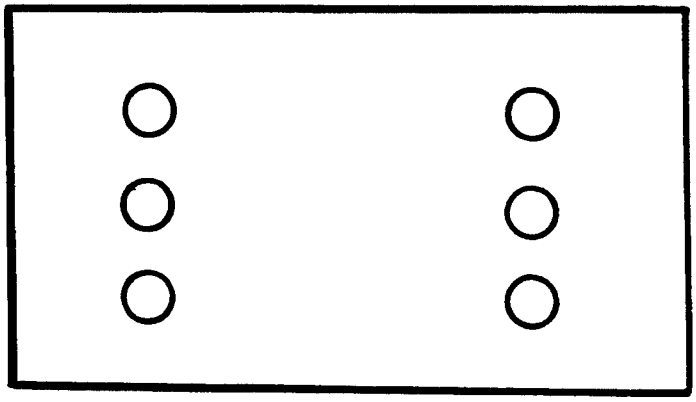
FIG. 6 is an enlarged side view of the channel showing the water jets.

Entrance channel 50' extends between soaking pool 40' and track 12'. Channel 50' has bottom 52', first side 54' and second side 56'. Door jets similar to door jets 59 shown in FIG. 5 are fixed to side 53' of entrance 52'. The door jets direct streams of water toward soaking pool 40' and prevent water from flowing from soaking pool 40' to track 12'.

Exercise pockets 70' are formed in outer side walls 18' of track 12'. Exercise pockets 70' may be of the same depth as track 12' or of greater or lessor depth. Exercise pockets 70' have bottom 72', first side 74', second side 76' and rear side 78'. Exercise pockets 70' may have water exercise equipment 79' disposed therein for use during an exercise or therapy program.

The exercise pool may be provided with a filtration system and other accessories commonly used with swimming pools that are familiar to those skilled in the art.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. An exercising and conditioning facility comprising a closed loop water track and a soaking pool;

said track having a bottom, an outside wall and an inside wall extending up from said bottom;

said bottom of said exercise and conditioning facility being substantially flat providing for generally constant depth water for walking or running exercises;

an island is formed inside said inside wall of said track;

said soaking pool is formed in said island;

said soaking pool having a bottom and an outside wall extending up from said bottom of said soaking pool and defining said soaking pool;

a channel formed in said island extending between said soaking pool and said track;

said channel having a substantially flat bottom whereby a user can walk through said channel between said track and said soaking pool.

2. The exercise and conditioning facility recited in claim 1 further comprising pumps and water jets positioned around said track to impart a constant velocity to water in said track in a range of 3 to 20 mph whereby said user walking with said flow is assisted for rehabilitation therapy and said user walking against said flow is resisted for exercise and conditioning therapy.

3. The exercise and conditioning facility recited in claim 1 wherein said constant velocity of water in said track is maintained in a preferred range of 7 to 10 mph.

4. The exercise and conditioning facility recited in claim 1 further comprising temperature control means for maintaining a temperature gradient in said water whereby said water in said soaking pool is maintained at a first temperature sufficiently high to reduce hypothermia in said user due to low physical effort activities, and said water in said track is maintained at a second temperature sufficiently low to cool said user due to aggressive activities in said track.

5. The exercise and conditioning facility recited in claim 4 wherein doors are provided in said channel to prevent flow of water through said channel and to maintain said temperature gradient between said pool and said track.

6. The exercise and conditioning facility recited in claim 4 wherein temperature gradient water jets are provided in said channel to maintain said temperature gradient.

7. The exercise and conditioning facility recited in claim 4 wherein said temperature difference is maintained within a range between 6° and 22° F.

8. The exercise and conditioning facility recited in claim 7 wherein said temperature difference is maintained within a preferred range of 6° to 10° F.

9. The exercise and conditioning facility recited in claim 4 wherein said temperature of said water in said track is maintained within a range of 80° to 88° F.

10. The exercise and conditioning facility recited in claim 4 wherein said temperature of said water in said track is maintained within a range of 84° to 88° F.

11. The exercise and conditioning facility recited in claim 4 wherein said temperature of said water in said soaking pool is maintained within a range of 88° to 102° F.

12. The exercise and conditioning facility recited in claim 4 wherein said temperature of said water in said soaking pool is maintained within a range of 94° to 96° F.

13. The exercise and conditioning facility recited in claim 1 further comprising a swimming area provided in said track;

said swimming area comprising a down slope in said bottom of said track which increases the depth of said water in said track so that a user must swim for some distance; and, an up slope in said bottom of said track which decreases the depth of said water in said track so that said user can resume walking or running along said track.

14. The exercise and conditioning facility recited in claim 1 further comprising exercise pockets;

said exercise pockets being located in said outside wall adjacent said track;

said pockets having a bottom and sides;

said exercise pockets being open to said track and adapted to have water exercise equipment positioned in said exercise pockets.

15. The exercise and conditioning facility recited in claim 1 wherein said bottom of said soaking pool is inclined from a first end of said soaking pool adjacent said channel to a second end of said soaking pool remote from said channel so that the depth of said soaking pool is sufficient to immerse a tall person in a standing position adjacent said second end of said soaking pool.

16. The exercise and conditioning facility recited in claim 1 further comprising a bridge extending across said track from said outside wall of said track to said inside wall of said track; and, said bridge crosses said track at a sufficient height that said bridge will not interfere with said user of said track.

17. The exercise and conditioning facility recited in claim 1 further comprises stairs to provide access to said track and a ramp to provide handicapped access to said track.

18. An exercising and conditioning facility comprising a closed loop water track and a soaking pool;

said track having a bottom, an outside wall and an inside wall extending up from said bottom of said exercise and conditioning facility and defining said track;

said bottom of said exercise and conditioning facility being substantially level providing for constant depth water for walking or running exercises;

a swimming area is provided in said track comprising a down slope in said bottom of said track which increases said water depth in said track so that a user must swim for some distance;

an up slope in said bottom of said track which decreases said water depth so that said user can resume walking or running;

an island is formed inside said inside wall of said track;

said soaking pool is formed in said island;

said soaking pool having a bottom and an outside wall;

a channel having a bottom is formed in said island extending between said soaking pool and said track;

said bottom of said channel being substantially level whereby said user can walk between said track and said soaking pool.

19. An exercising and conditioning facility comprising a closed loop water track and a soaking pool;

said track having a bottom, an outside wall and an inside wall extending up from said bottom;

said bottom of said exercise and conditioning facility being substantially flat providing for generally constant depth water for walking or running exercises;

an island is formed inside said inside wall of said track;

said soaking pool is formed in said island;

said soaking pool having a bottom and an outside wall extending up from said bottom of said soaking pool and defining said soaking pool;

a channel formed in said island extending between said soaking pool and said track;

said channel having a substantially flat bottom whereby a user can walk through said channel between said track and said soaking pool;

temperature control means for maintaining a temperature gradient in said water whereby said water in said soaking pool is maintained at a first temperature sufficiently high to reduce hypothermia in said user due to low physical effort activities and said water in said track is maintained at a second temperature sufficiently low to cool said user due to aggressive activities in said track.

20. An exercising and conditioning facility comprising a closed loop water track and a soaking pool;

said track having a bottom, an outside wall and an inside wall extending up from said bottom;

said bottom of said exercise and conditioning facility being substantially flat providing for generally constant depth water for walking or running exercises;

water pumping means and water jets are positioned around said track to impact a constant velocity to water in said track whereby a user walking with said flow is assisted for rehabilitation therapy and said user walking against said flow is resisted for exercise and conditioning therapy;

an island is formed inside said inside wall of said track;

said soaking pool is formed in said island;

said soaking pool having a bottom and an outside wall extending up from said bottom of said soaking pool and defining said soaking pool;

a channel formed in said island extending between said soaking pool and said track;

said channel having a substantially flat bottom whereby said user can walk through said channel between said track and said soaking pool.

21. The exercising and conditioning facility recited in claim 20 further comprising means to prevent whirlpool flow patterns from developing at an intersection of said track and said channel;

said means comprising widening a flow path of said track adjacent to and downstream from said intersection of said track and said channel.

* * * * *